US009299517B2

(12) United States Patent
Takeuchi

(10) Patent No.: US 9,299,517 B2
(45) Date of Patent: Mar. 29, 2016

(54) OPERATION KEYS HAVING INDIVIDUAL AND COOPERATIVE FUNCTIONS

(71) Applicant: RICOH IMAGING COMPANY, LTD., Tokyo (JP)

(72) Inventor: Rie Takeuchi, Tokyo (JP)

(73) Assignee: RICOH IMAGING COMPANY, LTD., Tokyo (JP)

( * ) Notice: Subject to any disclaimer, the term of this patent is extended or adjusted under 35 U.S.C. 154(b) by 17 days.

(21) Appl. No.: 14/492,466

(22) Filed: Sep. 22, 2014

(65) Prior Publication Data

US 2015/0090569 A1 Apr. 2, 2015

(30) Foreign Application Priority Data

Sep. 27, 2013 (JP) ..... 2013-200811

(51) Int. Cl.
*H01H 9/26* (2006.01)
*H01H 13/84* (2006.01)

(52) U.S. Cl.
CPC ..... *H01H 13/84* (2013.01); *H01H 2217/012* (2013.01); *H01H 2217/024* (2013.01); *H01H 2231/046* (2013.01)

(58) Field of Classification Search
CPC H01H 13/705; H01H 13/7057; H01H 25/041
USPC ..... 200/5 A, 5 R, 13, 18; 396/299, 543
See application file for complete search history.

(56) References Cited

U.S. PATENT DOCUMENTS 5,428,418 A 6/1995 Inaba
5,815,760 A * 9/1998 Ito ..... G03B 17/38 396/543
6,085,038 A 7/2000 Kobayashi
6,153,843 A * 11/2000 Date ..... A63F 13/06 200/339
6,313,731 B1 * 11/2001 Vance ..... H01H 13/70 200/5 A
6,329,622 B1 * 12/2001 Ando ..... H01H 25/041 200/537
6,377,685 B1 * 4/2002 Krishnan ..... G06F 3/0202 379/368
6,519,003 B1 * 2/2003 Swayze ..... H04N 1/00352 348/333.01
6,952,229 B1 * 10/2005 Takahashi ..... H04N 5/232 348/333.02
7,319,490 B2 * 1/2008 Kanamori ..... H04N 5/23293 200/313
7,477,318 B2 1/2009 Nakamura
7,697,054 B2 * 4/2010 Cazier ..... H04N 5/272 345/619
8,445,795 B2 * 5/2013 Vaziri ..... H01H 25/041 200/5 R
2003/0151807 A1 8/2003 Hirunuma et al.
2006/0113170 A1 * 6/2006 Rochon ..... H01H 25/06 200/5 R

FOREIGN PATENT DOCUMENTS

JP 6-154422 6/1994
JP 2003-272485 9/2003
JP 2003-338232 11/2003

* cited by examiner

*Primary Examiner* — Vanessa Girardi
(74) *Attorney, Agent, or Firm* — Greenblum & Bernstein P.L.C.

(57) ABSTRACT

An operation key assembly facilitates operation of a plurality of keys disposed in a mutually adjacent manner and facilitates operation by simultaneously operating the keys. The operation multi-direction key assembly includes a plurality of direction keys disposed in a mutually adjacent manner. In the operation key assembly, the plurality of keys can be singly operated or the mutually adjacent keys can be simultaneously operated. On an upper surface of an operation portion of the key, protrusions are formed in at least one part of a portion facing the adjacent key. By touching one key with the fingertip on the protrusion, the key can be singly operated on the basis of the touch of the finger. By simultaneously operating two mutually adjacent keys by simultaneously touching the protrusions of the two keys, the two mutually adjacent keys can be simultaneously operated on the basis of the touch of the finger.

8 Claims, 7 Drawing Sheets

OPERATION KEYS HAVING INDIVIDUAL AND COOPERATIVE FUNCTIONS

BACKGROUND OF THE INVENTION

1. Field of the Invention

The present invention relates to an operation key assembly for performing an operation for selecting one or more keys from among a plurality of keys and for performing a key input corresponding to the operated one or more keys. More specifically, the present invention relates to an operation key assembly which enables simultaneous operation of mutually adjacent keys.

2. Description of the Related Art

Button type keys, which are pressed and operated with the fingertip, have been used as operation keys for various apparatuses such as a camera. In particular, four-direction keys, in which four button type keys are arranged in a cross-like arrangement, have been used in cameras. As one form of such conventional four-direction keys, a configuration has been known in which the upper, lower, left, and right portions of one key can be respectively and separately operated and key inputs corresponding to the four directions of up, down, left, and right-direction portions can be performed in accordance with the operated portion. In addition, as another form of such conventional four-direction keys, a configuration has been known in which a pair of up-and-down-direction keys and a pair of horizontal-direction keys, i.e., four keys in total including up, down, left, and right keys, are circumferentially arranged and a key input corresponding to the operated key can be performed by selectively operating either one of the up, down, left, and right keys. Japanese Patent Application Laid-Open No. 2003-272485 discloses a technique for the former type four-direction key, in which either one of up, down, left, and right portions of a key with an annular plate shape is depressed and tilted and a key input corresponding to the direction of the tilt can be performed. In Japanese Patent Application Laid-Open No. 06-154422 discloses an example of a three-direction key, which is one form of the latter type key including three independent keys.

In these types of four-direction keys, key inputs can be performed in four directions of up, down, left, and right. In recent years, a conventional type key has been proposed, in which two mutually adjacent keys can be simultaneously operated to enable a key input corresponding to an intermediate direction between the two operated keys. In Japanese Patent Application Laid-Open No. 2003-272485, a key input corresponding to the upper right direction can be performed by operating and pressing down an intermediate portion between up and down portions, for example, of a key with an annular plate shape, i.e., by operating and pressing down the upper right portion of the key. More specifically, key inputs corresponding to eight directions in total can be performed, including key inputs corresponding to the four directions of up, down, left, and right directions and key inputs corresponding to the four intermediate directions between them. In addition, in Japanese Patent Laid-Open No. 06-154422, by simultaneously operating two mutually adjacent keys among circumferentially arranged three keys constituting a three-direction key, key inputs corresponding to the intermediate directions between the three keys can be performed. In other words, key inputs corresponding to six directions in total can be performed.

The four-direction keys of Japanese Patent Application Laid-Open No. 2003-272485 use a technique in which operations are performed in different positions of one key with an annular plate shape. To explain this in another way, it is a technique in which the up, down, left, and right portions and intermediate portions between them are operated. Accordingly, the operation of an intermediate portion can be performed in the same manner as that for the up, down, left, or right portion. However, because the intermediate portions are not clearly distinguished or separated from the up, down, left, and right portions, the user may operate the intermediate portion by mistake when the user desires to operate the up, down, left, or right portion. On the other hand, in a technique in which two mutually adjacent keys, among a plurality of circumferentially arranged keys, are simultaneously operated to perform a key input corresponding to an intermediate direction as in the three-direction key disclosed in Japanese Patent Application Laid-Open No. 06-154422, a problem may arise with respect to the ease of operation of the simultaneous operation of the two keys. More specifically, if the interval between the two mutually adjacent keys is small, the ease of operation of the simultaneous operation of these keys increases; however, if this interval is excessively small, the user may operate a wrong key by mistake which is adjacent to the one key desired to be operated. Conversely, if the interval between the mutually adjacent keys is large, the ease of operation in selecting and operating each key increases; however, it becomes difficult to simultaneously operate mutually adjacent keys.

To address the above-described problem, Japanese Patent Application Laid-Open No. 06-154422 employs a configuration in which the interval among the three keys is small, a protrusion is provided on an operation surface of each key, the protrusion is used in singly operating the respective keys, and the keys are simultaneously operated on their flat portion in simultaneously operating mutually adjacent keys. However, in cases in which it is difficult to arrange small intervals for mutually adjacent keys, a configuration is employed in four-direction keys disposed on a back surface of a camera, particularly, in which a determination key (determination button) is provided in the center of a region of the key and four ergonomically designed keys with a shape of a small fan are circumferentially arranged around the determination key. Therefore, in such cases, it is difficult to provide a small interval between mutually adjacent keys in the circumferential direction. Therefore, if the technique of Japanese Application Patent Laid-Open No. 06-154422 is applied as it is to this type of four-direction keys for cameras, it is difficult to improve the ease of operation in simultaneously operating mutually adjacent keys.

The purpose of the present invention is to provide an operation key assembly capable of improving the ease of operation.

SUMMARY OF THE INVENTION

According to an aspect of the present invention, an operation key assembly includes a plurality of keys disposed in a mutually adjacent manner. The plurality of keys is able to be operated each singly, and at least one pair of mutually adjacent keys thereof is able to be operated simultaneously. The operation key assembly comprises a protrusion that is formed on an operation surface of the key. The protrusions are positioned in at least one part of portion of the key which faces an adjacent key thereof. That is, in an aspect of the present invention, the plurality of keys is configured so that two mutually adjacent keys can be simultaneously operated by simultaneously touching the protrusions of the two mutually adjacent keys.

For the form of the protrusions, the protrusions may be configured as a part of the operation surface so as to protrude in a direction of height of the operation key assembly. Alternatively, the protrusions may be configured as a part of the operation surface so as to protrude in a direction of a surface plane of the operation key assembly.

In a preferred aspect of the present invention, the plurality of keys is arranged in a circumferential direction. The protrusions are formed on both ends in the circumferential direction of an operation surface, having a shape of a fan, of the keys. In particular, the plurality of keys is four direction keys disposed in up, down, left, and right locations, and the operation key assembly according to the present invention is configured as four-direction keys. In addition, the operation key assembly according to the present invention is configured as a switch for apparatuses including a camera.

According to the present invention, it is possible to provide an operation key assembly capable of improving the ease of operation.

DETAILED DESCRIPTION OF THE PREFERRED EMBODIMENTS

Figure 1:
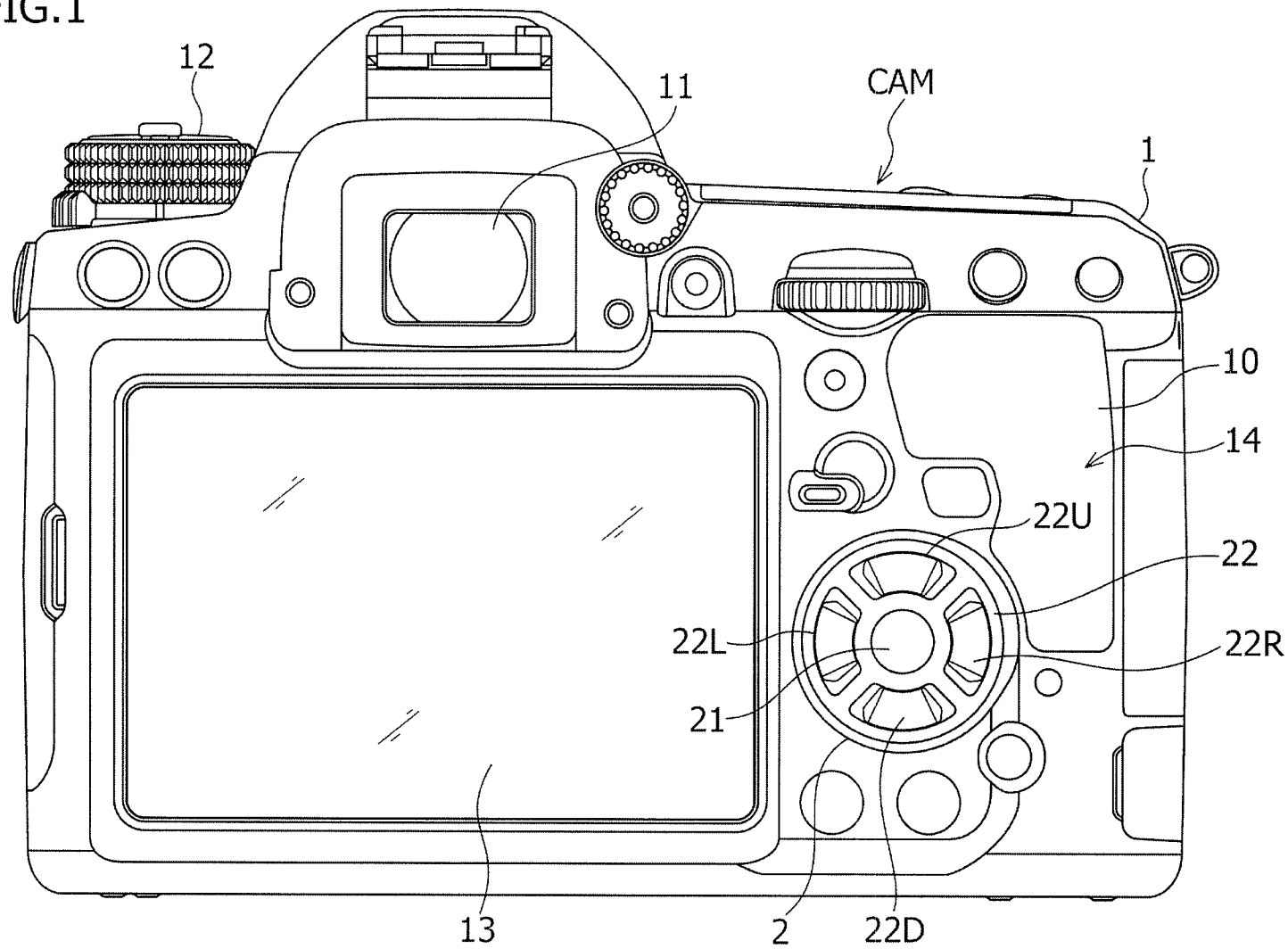
FIG. 1 is a rear view of a digital camera which includes an operation key assembly according to the present invention as four-direction keys.

Next, embodiments of the present invention will be described below with reference to the attached drawings. FIG. 1 is a rear view of a camera in an embodiment which includes an operation key assembly according to the present invention as four-direction keys provided on a back surface of a digital camera. In a camera body 1 of a digital single-lens reflex camera CAM, a monitor display device 13 is provided, which includes a viewfinder 11, a mode dial 12, a liquid crystal display (LCD), and the like. In addition, various operation buttons 14 are provided on the camera body 1. As one of the operation buttons 14, a four-direction key 2 is provided on a rear cover 10 which constitutes a part of the camera body 1. In the four-direction key 2, a determination key 21 including a circular button is provided in the center of a circular region which is divided on a portion of a back surface of the rear cover 10. Furthermore, respective direction keys 22 including an up key 22U, a down key 22D, a left key 22L, and a right key 22R, which respectively include a fan-shaped push button, are arranged in a circumferential direction in the upper, lower, left, and right portions around the determination key 21. The four-direction key 2 is arranged in a location in the right portion viewed from the back side of the camera body 1. Accordingly, the photographer is allowed, when the photographer grips (holds) the camera body 1 with the right hand, to press and operate each key of the four-direction key 2, i.e., the determination key 21 and the respective up, down, left, and right keys 22 with the thumb of the right hand. Of course, the photographer can also operate the respective keys 21, 22 of the four-direction keys 2 with the finger of one hand while holding the camera body 1 in the other hand. The direction keys 22 including the four direction keys 22U, 22D, 22L, and 22R are the keys according to the present invention, and the four-direction key 2 including the direction keys 22 is the operation key assembly according to the present invention.

The four circumferentially arranged direction keys 22 (22U, 22D, 22R, 22L) of the four-direction key 2 are respectively singly assigned with a function as a strobe setting key, a timer setting key, and the like, for example. Furthermore, the four direction keys 22 (22U, 22D, 22R, 22L) are configured so that they function as cursor keys for selecting an alternative when selections such as camera settings and the like are displayed on the LCD of the monitor display device 13. More specifically, a cursor displayed on the monitor display device 13 is positioned to the desired selection by vertically and horizontally moving the cursor by singly operating the four direction keys 22. In addition, the setting of the position of the cursor can be finally settled by operating the determination key 21 in the thus positioned state. For example, when the up key 22U is operated, the cursor is moved upward, and when the down key 22D is operated, the cursor is moved downward. Accordingly, the determination key and the respective direction keys are configured so that they can be operated independently from one another. Furthermore, if a large number of alternatives are displayed in a matrix, the cursor can be moved in the upper-right direction, for example, by simultaneously operating the up key 22U and the right key 22R. In this manner, the cursor can be quickly positioned to an alternative displayed on the upper-right position. This also applies to the other direction keys. More specifically, the cursor can be moved in the lower-right, lower-left, and upper-left directions, respectively, by simultaneously operating the mutually adjacent direction keys 22 arranged in the circumferential direction.

Figure 2A:
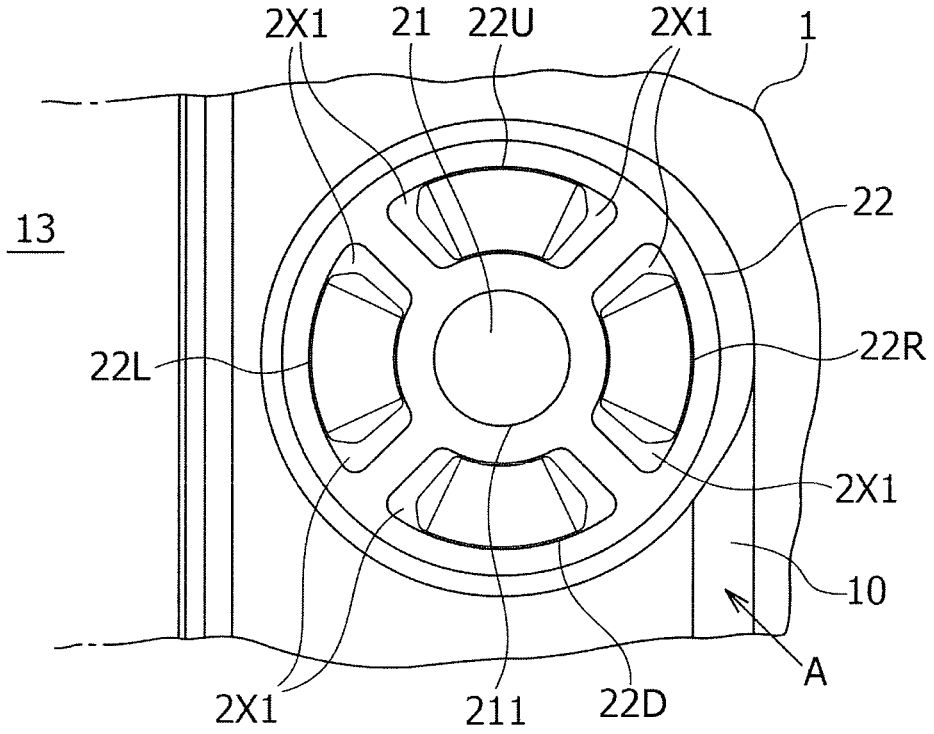
FIG. 2A is a front view of the four-direction keys according to a first embodiment.
Figure 2B:
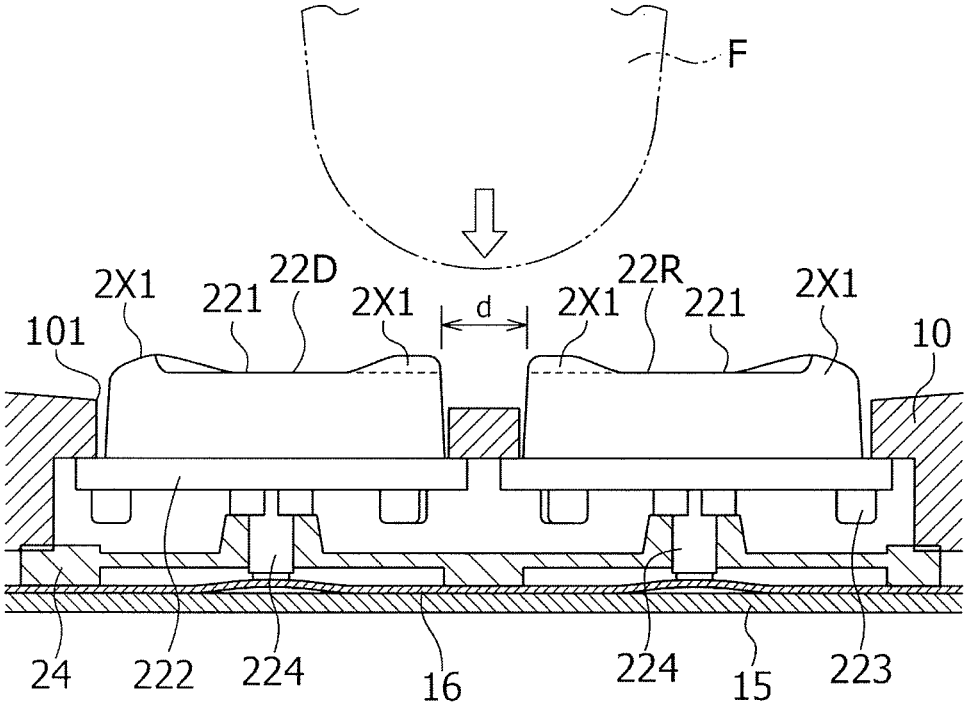
FIG. 2B is a cross section of the four-direction keys viewed in a direction A in FIG. 2A.

FIG. 2A is an enlarged front view of the four direction key 2. FIG. 2B is an enlarged cross section of the example illustrated in FIG. 2A viewed from the direction A, for explaining the inner configuration of the four direction key 2. In a part of the rear cover 10, the determination key 21 and the respective up, down, left, and right keys 22 are disposed through (piercing) the rear cover 10 in the direction of thickness of the plate of the rear cover 10. In addition, upper ends of the keys 21, 22, which are configured as operation portions of the keys 21, 22, are exposed toward the outside of the camera body. As shown in FIG. 2B, the direction keys 22 include an operation portion 221 having a shape of a fan-like button, a flange-shaped retaining portion 222 provided on the lower edge of the operation portion 221, a holding portion 223 which protrudes downward from a lower surface of the retaining portion 222, and a rod-like acting portion 224 which protrudes downward from a location immediately below the operation portion 221. These portions of the direction keys 22 are formed from a resin material by integral molding. The operation portion 211 of the determination key 21 is formed as a circular push button, and the detailed description thereof will not be repeated here because the other configurations are substantially the same as those of the direction keys.

In addition, the operation portion 221 of the direction keys 22 is inserted into respective support holes 101, which are formed and opened through the rear cover 10. An elastic support plate 24 is mounted from below the direction keys 22. The elastic support plate 24 has a thick peripheral edge and contacts the upper surface of a sheet switch 16 described below on the peripheral edge to provide waterproofing for the inner regions, and also elastically support the direction keys 22 vertically against the rear cover 10 at the acting portions 224 which protrude downwards from the approximate center of the lower surface of the direction keys 22. Elastically supported by the elastic support plate 24, the direction keys 22 are respectively in a state in which the retaining portions 222 are engaged with the inner edge of the support holes 101 in the support holes 101 and thereby the direction keys 22 are prevented from dropping off. In addition, in this state, the operation surface of the operation portions 221 (i.e., the upper surface of the operation portions 221) of the direction keys 22 protrudes from the surface of the rear cover 10. In addition, a plurality of holding portions 223 with a shape of a protrusion is provided in a peripheral portion on the lower surface of the direction keys 22. When the direction keys 22 are operated, the holding portions 223 contact the elastic support plate 24. The sheet switch 16, including a plurality of switches integrated together, i.e., five switches integrated together in the present embodiment, is provided below the rear cover 10. The sheet switch 16 is disposed on the surface of a metal substrate 15. The above-mentioned switches are formed in locations corresponding to the locations of the determination key 21 and the direction keys 22 so as to perform a switching action when the sheet switch 16 is deformed downward. The lower ends of the acting portions 224 of the direction keys 22 are respectively positioned adjacent to the surface of each of the four switches. In addition, the sheet switch 16 is electrically connected with a control circuit (not illustrated) so that an electric signal corresponding to the switch which has been turned on is output. Note that the configuration of the determination key 21 is substantially the same as that of the direction keys 22, and the determination key 21 is positioned at a position corresponding to the other one switch of the sheet switch 16.

Switching actions of the four-direction key 2 with respect to the direction keys 22 will be described below. When the fingertip of an operator (photographer) contacts the upper surface of the operation portion 221, i.e. the operation surface, of the direction keys 22 and the operation portion 221 is pressed down by a pressing operation with the finger, the acting portion 224 and the operation portion 221 are integrally moved downwards together, and thus the corresponding switch of the sheet switch 16 is turned on. In addition, when the pressing operation with the finger is released, the direction keys 22 are moved upward to their initial position due to the elastic return force of the elastic support plate 24 or due to the elastic return forces of the sheet switch 16 and the elastic support plate 24. Thus, the corresponding switch is turned off. In this state, the direction keys 22 are held in a state in which they are in contact with the elastic support plate 24 in the holding portion 223. Accordingly, even if the direction keys 22 have been tilted from the vertical state by a pressing operation on only a part of an operation surface, for example, the acting portion 224 is moved downward while maintaining the above-described state due to the support by the holding portion 223, and thereby the switch is turned on. In addition, when the pressing operation on the direction keys 22 is released, the posture of the direction keys 22 is returned to the straight posture due to the support by the elastic support plate 24. In the four-direction key 2, the cursor displayed on the monitor display device 13 is moved in the corresponding direction due to the electric signal transmitted when the switch is turned on by the direction keys 22.

Figure 3:
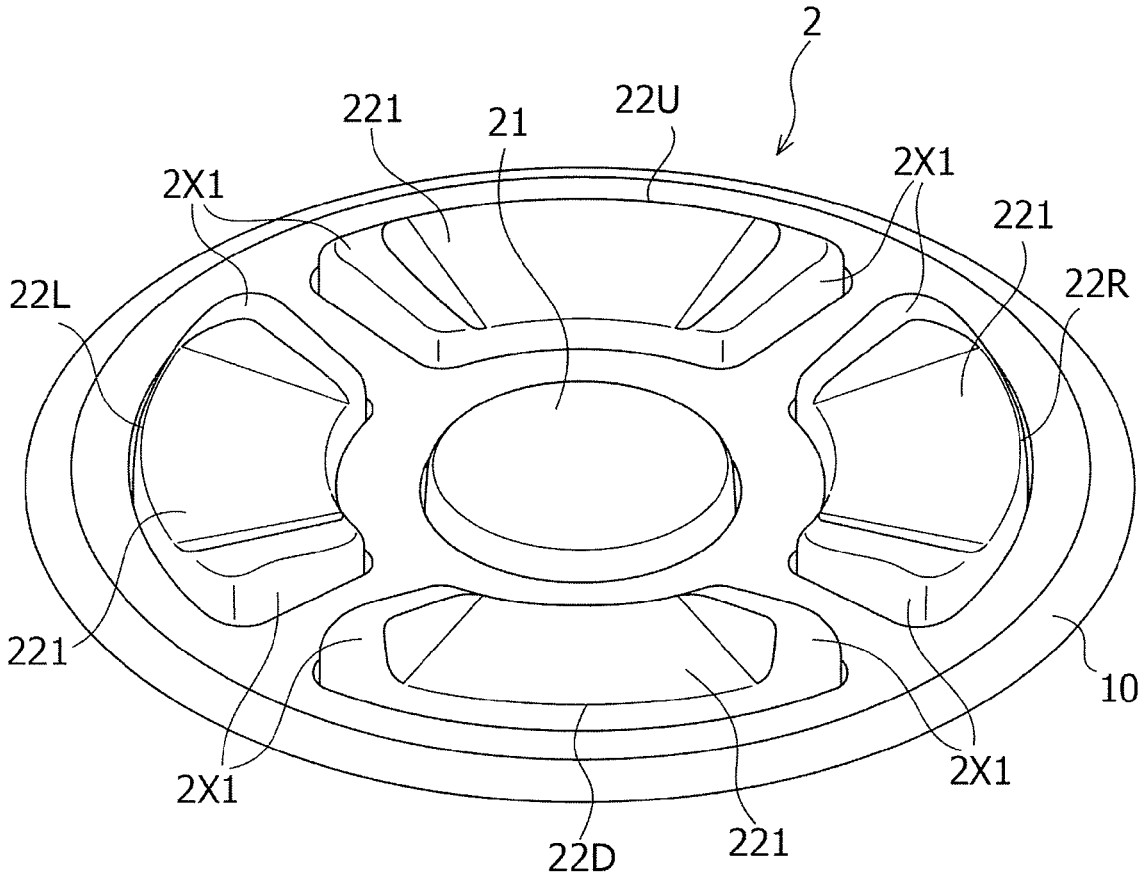
FIG. 3 is an external perspective view of the four-direction keys according to the first embodiment.

With respect to the direction keys 22, an interval dimension between the circumferentially arranged mutually adjacent direction keys 22, i.e., an interval dimension d between the down key 22D and the right key 22R illustrated in FIG. 2B, for example, is set to be smaller than a width dimension of an average human finger F. In other words, the direction keys 22 are configured so that the mutually adjacent direction keys 22D, 22R can be simultaneously operated with the tip of one finger, ideally with the tip of the thumb. In addition, on the operation surface of each of the direction keys 22, protrusions 2X1, which increase the height of the operation surface partially, are formed integrally with the operation surface in the portion facing the direction key adjacent in the circumferential direction, in other words, on both ends in the circumferential direction. In the present first embodiment, as illustrated in the external perspective view of FIG. 3, the protrusions 2X1, which respectively extend in the radial direction, are formed on both ends across the center in the circumferential direction of the fan-shaped operation portion 221 of the direction keys 22. The protrusions 2X1 are formed as protrusions with a narrow width arranged in the circumferential direction. In addition, the protrusions 2X1 are formed in a tapered shape in which the height of the protrusions 2X1 in relation to the operation surface gradually increases from the inner periphery side toward the outer periphery side. The configuration of the protrusions 2X1 is the same for the four direction keys 22U, 22D, 22R, 22L. With this configuration, for the two mutually adjacent direction keys 22, the protrusions 2X1 facing to each other are disposed in the circumferential direction with an interval dimension d.

With the protrusions 2X1, in a case in which the four direction keys 22 of the four-direction key 2 are singly operated, when the tip of the finger F used in the operation contacts the operation surface, the fingertip simultaneously contacts the protrusions 2X1 on both side portions of the direction keys 22. Accordingly, the operator (photographer) can position the fingertip in the center of the operation portion 221 of the direction keys 22, on the basis of the touch of the fingertip on the protrusions 2X1, without visually recognizing the direction keys 22. Thus, the direction keys 22 can be securely singly operated. On the other hand, in a case in which the two mutually adjacent keys, i.e., the down key 22D and the right key 22R, for example, are simultaneously operated, by moving the fingertip from the currently contacting down key 22D rightward in the circumferential direction along the operation surface, and further moving after touching the protrusion 2X1 on the right side, the fingertip contacts the protrusion 2X1 on the left side of the right key 22R, and thus the fingertip simultaneously contacts the mutually facing protrusions 2X1 of the two direction keys 22D, 22R. Then, when the fingertip is placed at an intermediate location between the two direction keys on the basis of the touch recognized in the above-described state, the fingertip is simultaneously caught by the tapered portions of the two protrusions 2X1. By pressing and operating the two direction keys 22D, 22R in this state, the two direction keys 22D, 22R can be simultaneously securely operated.

In this operation, the touch of the fingertip on one or more of the protrusions 2X1 is absolutely different between the case of singly operating direction keys 22 and the case of simultaneously operating the mutually adjacent direction keys 22. Accordingly, the operator can recognize whether the operator is currently singly operating the direction keys 22 or simultaneously operating two direction keys 22, only on the basis of the touch of the fingertip, without visually inspecting the direction keys 22. In addition, while the two direction keys 22 are being simultaneously operated, the reaction force of manipulation transmitted from the protrusions 2X1 of both direction keys 22 to the fingertip is felt. Thus, a uniform operation force can be applied to the two direction keys 22, and thereby turning on or off of the two direction keys 22 can be easily performed at the same timing. Accordingly, even if a large number of alternatives are displayed on the monitor display device 13 in a matrix, the cursor can be moved in the upper-right direction, for example, by simultaneously operating the up key 22U and the right key 22R, and thus the cursor can be quickly and securely set at the alternative to be designated.

Figure 4A:
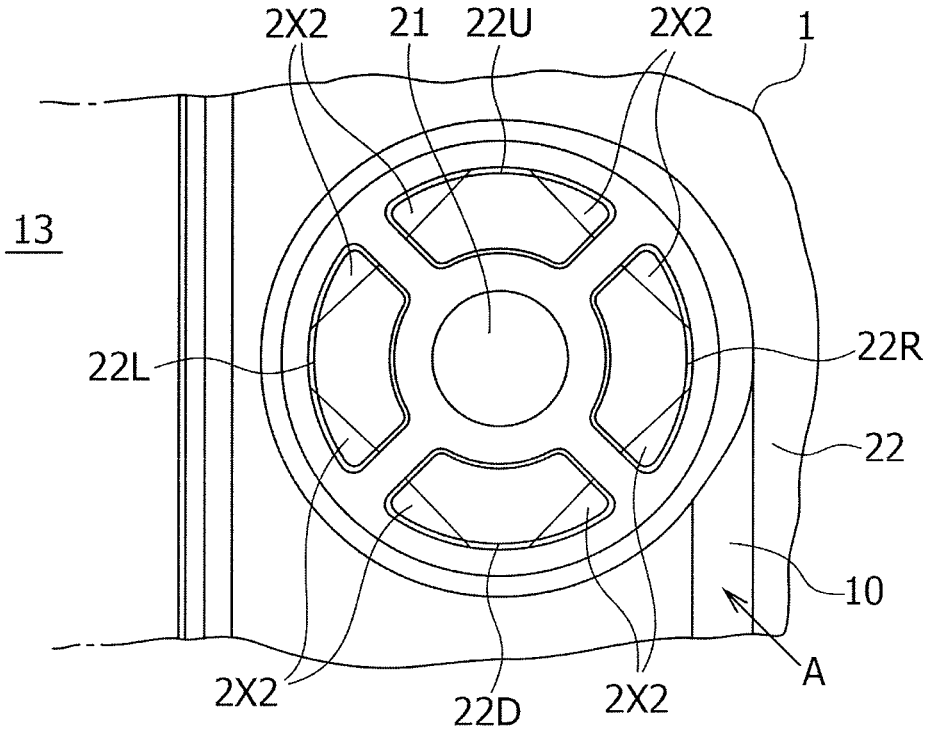
FIG. 4A is a front view of the four-direction keys according to a second embodiment.
Figure 4B:
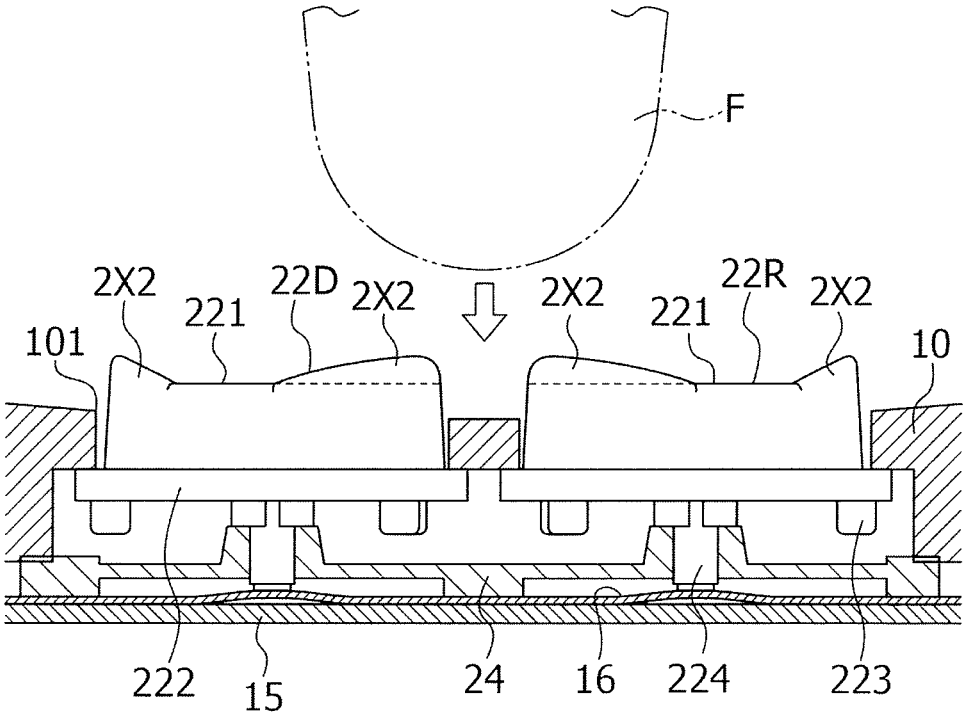
FIG. 4B is a cross section of the four-direction keys viewed in a direction A in FIG. 4A.

FIG. 4A is an enlarged front view of the four-direction key according to a second embodiment, in which protrusions provided on the direction keys 22 have an alternative shape. FIG. 4B is a cross section of the four-direction key viewed in a direction A in FIG. 4A. Components equivalent to those in the first embodiment are provided with the same reference numerals and symbols. In the present second embodiment, protrusions 2X2 are formed on the operation surface (upper surface) of the fan-shaped operation portion 221 of the direction keys 22. More specifically, the protrusions 2X2 have a planar shape of a triangular shape and are formed in regions which are on both ends of the direction keys 22 in the circumferential direction and include a corner on the outer peripheral edge. In addition, the protrusions 2X2 are formed in a tapered shape in which the height thereof gradually increases from the center of the operation surface in the circumferential direction toward both ends thereof. In particular, with respect to the tapered shape, the tapered edges of the protrusions 2X2 of the two mutually adjacent direction keys 22 are linearly arranged in a direction perpendicular to the radial direction, i.e., linearly arranged in the tangential direction.

In the second embodiment, in a case of singly operating the direction keys 22, when the operator (photographer) contacts the operation surface with the fingertip F, the operator can position the fingertip at the center of the operation surface on the basis of the touch of the fingertip on the protrusions 2X2 on both ends of the operation surface. Accordingly, the direction keys 22 can be securely and singly operated. In a case of simultaneously operating the two mutually adjacent direction keys 22, the operator (photographer) touches the respective protrusions 2X2 of the two mutually adjacent direction keys 22 with the fingertip and simultaneously touches the protrusions 2X2 of the two direction keys 22 on the basis of the touch of the fingertip. Thus, the operator can position the fingertip at the intermediate location between the protrusions 2X2. Accordingly, the two direction keys 22 can be simultaneously operated while applying a uniform operation force thereon. In particular, since in the second embodiment, the tapered edges of the protrusions 2X2 of the two mutually adjacent direction keys are oriented in the tangential direction perpendicular to the radial direction, the two mutually adjacent direction keys 22 can be easily operated at the same timing by simultaneously operating the two direction keys 22 toward the outer diameter thereof.

Figure 5A:
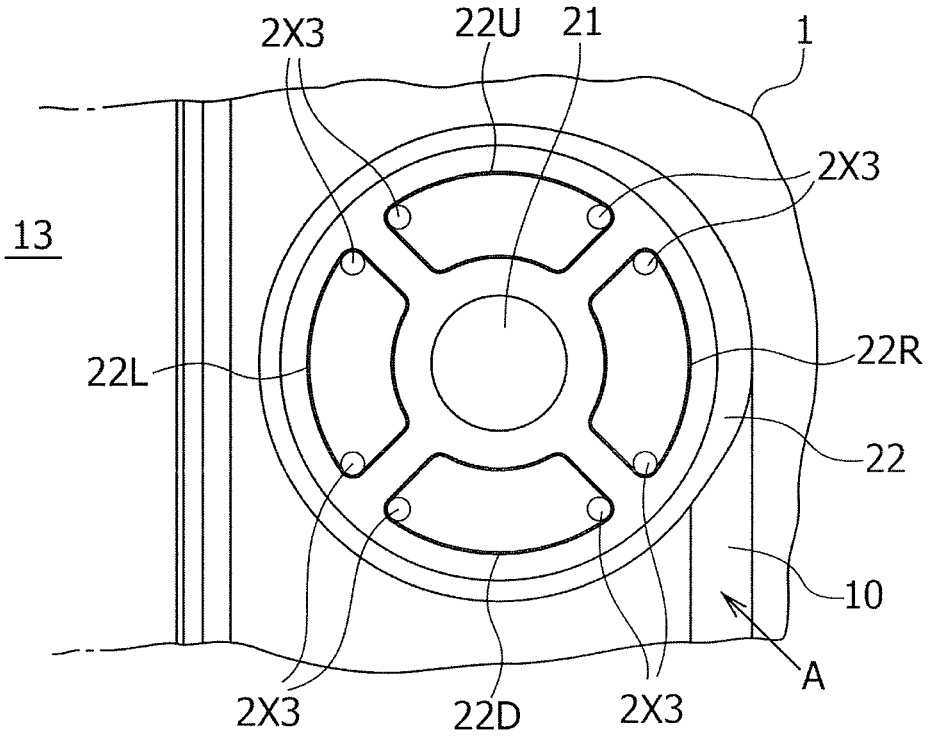
FIG. 5A is a front view of the four-direction keys according to a third embodiment.
Figure 5B:
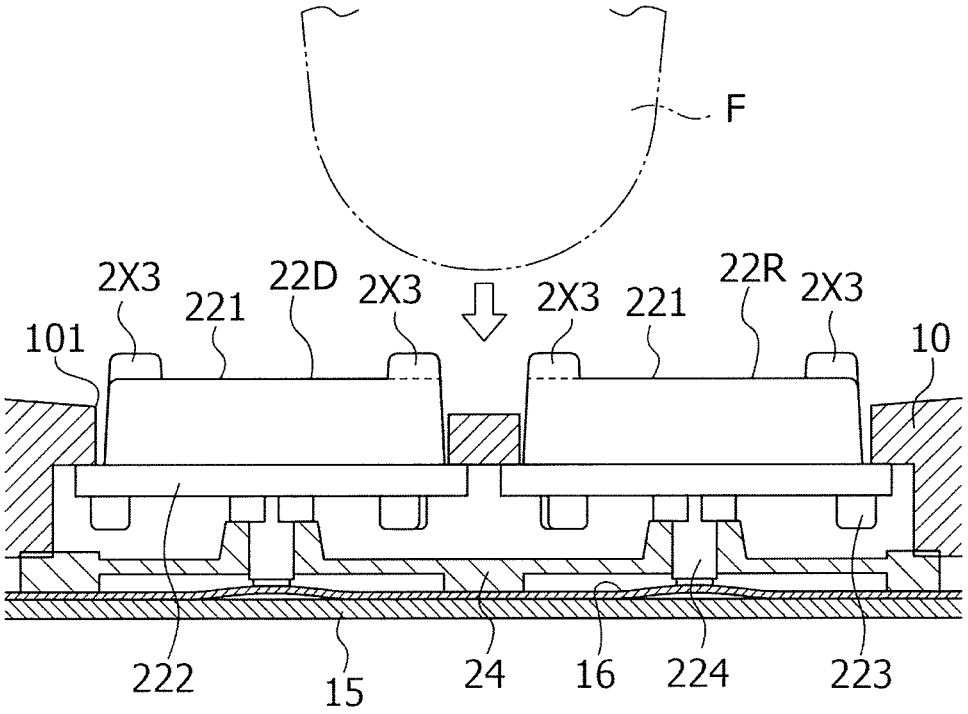
FIG. 5B is a cross section of the four-direction keys viewed in a direction A in FIG. 5A.

FIG. 5A is an enlarged front view of the four-direction key according to a third embodiment, in which protrusions provided to the direction keys 22 have an alternative shape. FIG. 5B is a cross section of the four-direction key viewed in a direction A in FIG. 5A. Components equivalent to those in the first embodiment are provided with the same reference numerals and symbols. In the third embodiment, protrusions 2X3 have a shape of a short column erected on the operation surface on both ends of the fan-shaped direction keys 22 in the circumferential direction along the outer peripheral edge of the direction keys 22. More specifically, the short columns are erected as protrusions 2X3 integrally on both ends of the operation surface of the circumferentially arranged direction keys 22 in the circumferential direction. The operation surface of the direction keys 22 is configured as an entirely flat surface.

In the third embodiment, in a case of singly operating the direction keys 22, when the operator (photographer) contacts the operation surface with the fingertip F, the operator can position the fingertip F at the center of the operation surface on the basis of the touch felt by simultaneously touching the protrusions 2X3 formed on both ends of the flat operation surface. Accordingly, the direction keys 22 can be securely singly operated. In a case of simultaneously operating the two mutually adjacent direction keys 22, the operator can position the fingertip F at the center of the two direction keys 22 by simultaneously touching the mutually facing protrusions 2X3 of the two direction keys 22 with the fingertip. Accordingly, the two direction keys 22 can be simultaneously operated while applying a uniform operation force thereon. Since the protrusions 2X3 according to the third embodiment have the shape of a short column, the protrusions 2X3 can be distinctly recognized on the basis of the touch at the fingertip. In addition, it is enabled to securely verify and recognize whether the fingertip is positioned at the center of the operation surface of the direction keys 22 or at an intermediate location between the two direction keys 22, by feeling the difference in the interval dimensions of the protrusions 2X3 in the circumferential direction.

Figure 6A:
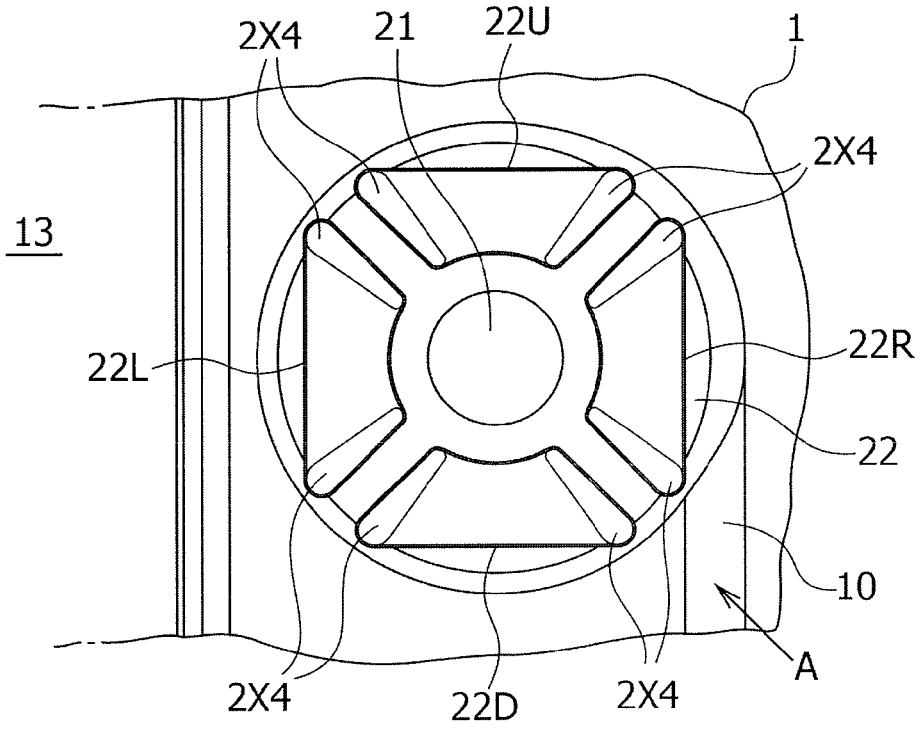
FIG. 6A is a front view of the four-direction keys according to a fourth embodiment.
Figure 6B:
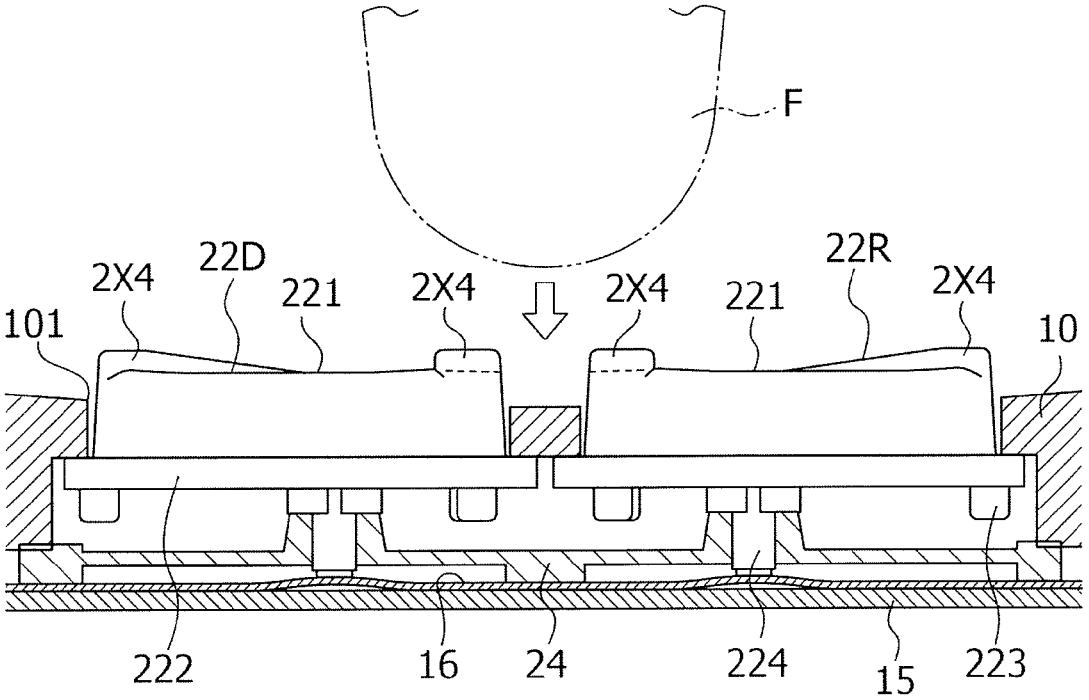
FIG. 6B is a cross section of the four-direction keys viewed in a direction A in FIG. 6A.

FIG. 6A is an enlarged front view of the four-direction key according to a fourth embodiment, in which protrusions provided on the direction keys 22 have an alternative shape. FIG. 6B is a cross section of the four-direction keys viewed in a direction A in FIG. 6A. Components equivalent to those in the first embodiment are provided with the same reference numerals and symbols. In the fourth embodiment, the operation portion 221 of the direction keys 22 is formed as a button having a shape of a modified fan in which a linear periphery of the fan is oriented in the tangential direction. In addition, protrusions 2X4 are formed as narrow linear protrusions extending in the radial direction along both ends of the operation surface having the shape of the modified fan in the circumferential direction, i.e., along both edges on which the two mutually adjacent direction keys 22 face each other. The protrusions 2X4 are configured so that the width dimension gradually and slightly increases and also the height gradually increases, from the inner periphery side toward the outer periphery side. In addition, the protrusions 2X4 are extended more outward in the radial direction than the protrusions of the first to the third embodiments because of the shape of the button of the direction keys 22 having the shape of the modified fan. Accordingly, the four-direction key has an approximately rectangular shape overall.

In the fourth embodiment, the direction keys 22 can be securely and singly operated in the similar manner to the first embodiment. In addition, in a case of simultaneously operating the two mutually adjacent direction keys 22, while the operator simultaneously touching the two direction keys 22, the operator can position the fingertip at an intermediate location between the direction keys 22 on the basis of the touch on the fingertip, by touching the mutually facing protrusions 2X4 of the two direction keys 22 with the fingertip. Accordingly, the two direction keys 22 can be simultaneously operated while applying a uniform operation force thereon. In this operation, the protrusions 2X4 of the fourth embodiment can be easily contacted than those of the first to the third embodiments because the protrusions 2X4 of the fourth embodiment are configured so as to be longer than the protrusions of the first to the third embodiments in the radial direction. Accordingly, the two mutually adjacent direction keys 22 can be securely and simultaneously operated.

Figure 7A:
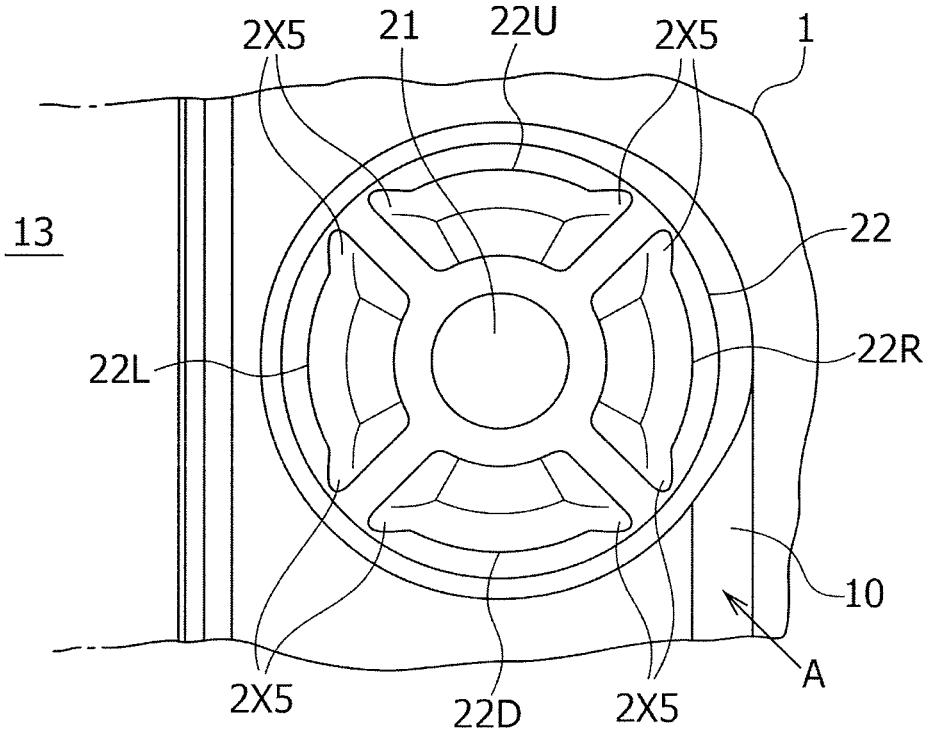
FIG. 7A is a front view of the four-direction keys according to a fifth embodiment.
Figure 7B:
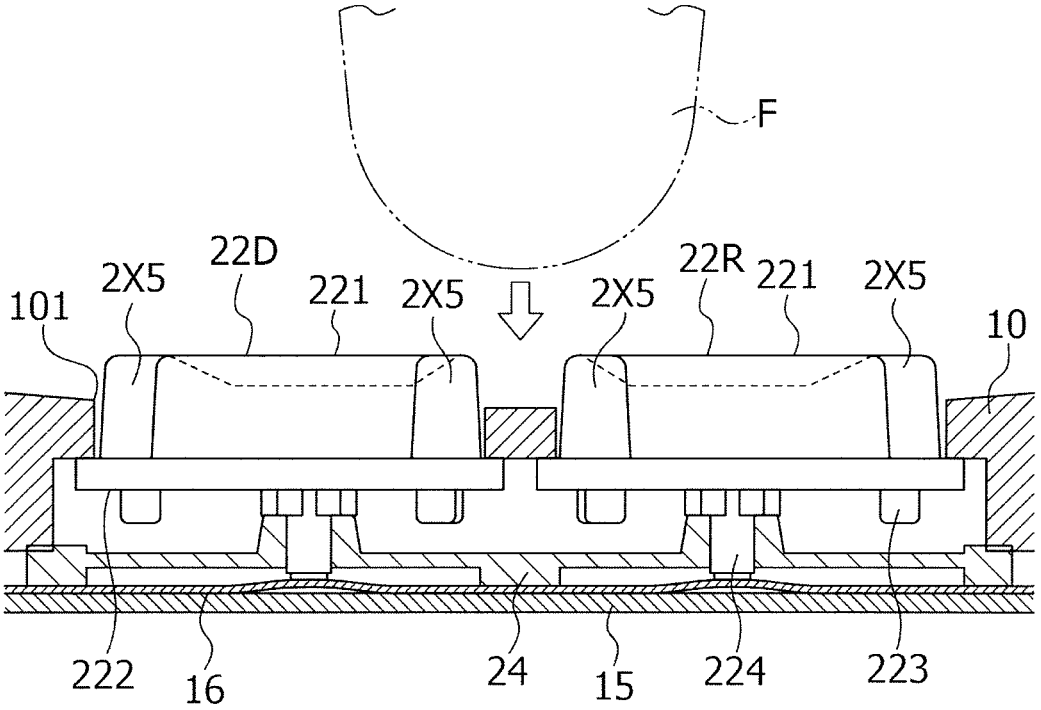
FIG. 7B is a cross section of the four-direction keys viewed in a direction A in FIG. 7A.

FIG. 7A is an enlarged front view of the four-direction key according to a fifth embodiment, in which protrusions provided to the direction keys 22 have an alternative shape. FIG. 7B is a cross section of the four-direction key viewed in a direction A in FIG. 7A. Components equivalent to those in the first embodiment are provided with the same reference numerals and symbols. In the fifth embodiment, protrusions 2X5, which are protrusions having a shape of a horn protruded toward the outer diameter, are formed on both ends along the outer peripheral edge of the operation surface of the fan-like direction keys 22, i.e., on both ends of the mutually adjacent direction keys 22 facing each other in the circumferential direction. In other words, the protrusions 2X5 with a radial shape are formed on both ends of the respective direction keys 22 in the circumferential direction. In the fifth embodiment, the operation surface of the direction keys 22 may be a flat surface, and the operation surface is configured so that the height of both ends in the circumferential direction including the protrusions 2X5 and the height of the outer periphery are higher than the height of the other region, i.e., the center of the operation surface.

In the fifth embodiment, in a case of singly operating the direction keys 22, the operator can position the fingertip at the center of the operation surface by touching both ends and the outer periphery, which is formed higher than the center, of the operation surface with the finger. Accordingly, the direction keys 22 can be securely and singly operated. In a case of simultaneously operating the two mutually adjacent direction keys 22, the radial protrusions 2X5 formed in the mutually facing portions of the mutually adjacent direction keys 22 can be touched by moving the fingertip in the circumferential direction while sliding the fingertip toward the outer diameter of the operation surface. The operator can position the fingertip at the intermediate location between the two direction keys 22 by simultaneously touching the protrusions 2X5 of the two adjacent direction keys 22 on the basis of the touch felt in the above-described manner. Accordingly, the two direction keys 22 can be simultaneously operated while applying a uniform operation force thereon. In addition, the protrusions 2X5 are protruded toward the outer diameter more compared with the protrusions 2X4 of the fourth embodiment. Accordingly, the fifth embodiment is advantageous in enabling a secure and simultaneous operation of the two mutually adjacent direction keys 22.

The direction keys 22 and the protrusions 2X1 to 2X5 according to the first to the fifth embodiments are described above. It is preferable to properly adjust the front shape and the dimensions of the protrusions, i.e., the shape and the dimensions thereof viewed from the rear side of the camera body, and the height dimension of the protrusions in relation to the operation surface, in accordance with the dimension and the shape of the direction keys. That is, the shape and the dimensions of the protrusions may be designed so that: in a case of singly operating the direction key, the protrusions do not obstruct the operation and do not degrade the ease of operation; and also in a case of simultaneously operating two mutually adjacent direction keys, the two direction keys can be simultaneously operated with uniform operation force by allowing the protrusions of the two direction keys to be securely caught by the tip of the finger operating the keys.

According to the above-described embodiments, by touching the one or more protrusions with fingertip, a state of contact with one key and a state of contact with two mutually adjacent keys can be recognized. Accordingly, the keys can be securely singly operated and the two keys can be securely simultaneously operated. Thus, the ease of operation of the keys can be improved. More specifically, in singly operating the keys, when the tip of the finger used in the operation is brought into contact on the operation surface, the fingertip contacts the protrusion of the key. Accordingly, the operator can position the tip of the finger on the key on the basis only of the touch of the fingertip on the protrusion, without visually recognizing the key, and can securely operate the desired key. On the other hand, in simultaneously operating two mutually adjacent keys, by moving the tip of the finger used in the operation to make the tip touch the protrusions on the two keys simultaneously, the operator can position the fingertip at an intermediate location between the two keys. Accordingly, the operator can simultaneously and securely operate the two keys.

In the above-described embodiments, examples are described in which the operation key assembly of the present invention is applied to a four-direction key including four direction keys. However, the operation key assembly of the present invention can be applied to a two-direction key including two keys arranged in the horizontal or vertical directions, or to a three-direction key, such as the key disclosed by Japanese Patent Application Laid-Open No. 06-154422, in which three keys are circumferentially arranged. Furthermore, the operation key assembly of the present invention can be applied to a multi-direction key including five or more keys. In addition, in the above-described embodiments, the determination key is disposed in the center of the region for the direction key. However, the present invention can be applied to a direction key without a determination key. Furthermore, the present invention can be applied to an operation key assembly including keys other than direction keys such as an operation key assembly in which a plurality of keys are linearly arranged, for example, and to an operation key assembly in which a plurality of keys is arranged in a matrix in the vertical and horizontal directions, such as a numeric key. If the present invention is to be applied to the above-described types of operation key assemblies, the protrusions may be formed in portions of mutually adjacent keys on mutually facing sides thereof.

In the above-described embodiments, the operation key assembly of the present invention is configured as one of operation buttons of a digital camera. However, the operation key assembly of the present invention can be applied as operation buttons for various types of apparatuses such as a video camera for taking moving images, a mobile terminal device, or the like.

INDUSTRIAL APPLICABILITY

The present invention is useful when employed as an operation key assembly including a plurality of keys which can be singly operated or simultaneously operated.

The disclosure of Japanese Applications No. 2013-200811 filed on Sep. 27, 2013 including specification, claims, drawings and abstract thereof are incorporated herein by reference in their entirety.

REFERENCE SIGNS LIST

1 camera body
2 four-direction key (operation key assembly)
2X1 to 2X5 protrusions
10 rear cover
11 viewfinder
12 mode dial
13 monitor display device

14 various buttons
15 metal substrate
16 sheet switch
21 determination key
22 (22U, 22D, 22R, 22L) direction keys (keys)
24 elastic support plate
221 operation portion (operation surface)
224 acting portion

What is claimed is:

1. An operation key assembly, including a plurality of keys disposed in a mutually adjacent manner, the plurality of keys being able to be operated each singly and at least one pair of mutually adjacent keys thereof being able to be operated simultaneously, comprising a protrusion that is formed on an operation surface of the key, the protrusion being positioned in at least one part of a portion of the key which faces an adjacent key thereof.

2. The operation key assembly according to claim 1, wherein the plurality of keys is configured so that two mutually adjacent keys can be simultaneously operated by simultaneously touching the protrusions of the two mutually adjacent keys.

3. The operation key assembly according to claim 1, wherein the protrusion is configured as a part of the operation surface so as to protrude in a direction of height of the operation key assembly.

4. The operation key assembly according to claim 1, wherein the protrusion is configured as a part of the operation surface so as to protrude in a direction of a surface plane of the operation key assembly.

5. The operation key assembly according to claim 1, wherein the operation key is configured as a switch for apparatuses including a camera.

6. The operation key assembly according to claim 1, wherein the plurality of keys is configured so that two mutually adjacent keys can be simultaneously operated by touching the protrusions of the two mutually adjacent keys with one finger.

7. The operation key assembly according to claim 1, wherein the plurality of keys is arranged in a circumferential direction, and wherein the protrusions are formed on both ends in the circumferential direction of an operation surface, having a shape of a fan, of the keys.

8. The operation key assembly according to claim 7, wherein the plurality of keys is four direction keys disposed in up, down, left, and right locations.

* * * * *